US005097605A

United States Patent [19]

Kashino et al.

[11] Patent Number: 5,097,605

[45] Date of Patent: Mar. 24, 1992

[54] PHOTOSENSITIVE MATERIAL PROCESSING APPARATUS

[75] Inventors: Teruo Kashino; Toshiyuki Yamagishi; Masakazu Andoh; Toshio Fujisaka, all of Hino, Japan

[73] Assignee: Konica Corporation, Tokyo, Japan

[21] Appl. No.: 499,172

[22] Filed: Mar. 26, 1990

[30] Foreign Application Priority Data

Mar. 31, 1989 [JP] Japan ..... 1-87752
Apr. 6, 1989 [JP] Japan ..... 1-81780

[51] Int. Cl.[5] ..... F26B 7/00

[52] U.S. Cl. ..... 34/18; 34/68; 34/41; 34/155; 354/300

[58] Field of Search ..... 34/68, 18, 155, 156, 34/41, 54, 60; 354/300

[56] References Cited

U.S. PATENT DOCUMENTS 4,245,397 1/1981 Laar ..... 34/41 X
4,495,713 1/1985 Williner ..... 34/41 X
4,936,025 6/1990 Heikkila ..... 34/18

*Primary Examiner*—Henry A. Bennet
*Attorney, Agent, or Firm*—Frishauf, Holtz, Goodman & Woodward

[57] ABSTRACT

The invention provides a photosensitive material processing apparatus having a processing part consisting of a plurality of processing tanks for processing a photosensitive and a drying part, disposed downstream of the processing part in a processing sequence, for drying the material. The drying part includes infrared drying system and hot air current drying system. There are provided a distinguishing circuit and a controlling circuit. The distinguishing circuit distinguishs the condition of the material either on a constant-drying-rate condition or on a decreasing-drying-rate condition on the basis of physical characteristics of the material. The controlling circuit controls the drying part so as to use the infrared drying system on the constant-drying-rate-condition or to use the hot air current drying system on the decreasing-drying-rate-condition on the basis of a distinguishing result of the distinguishing circuit.

18 Claims, 5 Drawing Sheets

PHOTOSENSITIVE MATERIAL PROCESSING APPARATUS

BACKGROUND OF THE INVENTION

This invention relates to improvements in a photosensitive material processing apparatus.

A photosensitive material processing apparatus in which the photosensitive material is developed, fixed, washed, and dried in a drying unit as it is being conveyed, is used to process the exposed photosensitive material.

There are two conventional systems to dry photosensitive materials. One is the hot air current type drying system in which a hot air current is blown against the photosensitive materials and the other is the infrared type drying system in which the photosensitive materials are irradiated with infrared rays. The drying system is an important factor for a photosensitive material processing apparatus to improve image quality, to increase its processing capacity, to cut down on its energy consumption, and to simplify its structure so as to be made compact. In the hot air current type drying system, it takes a long time to dry the photosensitive materials, although the system has the advantage of being able to dry the photosensitive materials gently and uniformly, and to obtain a high quality image. In order to reduce the drying time, some measures can be considered such as extending the photosensitive material conveying passage in the apparatus or providing a heater with greater heating capacity to the apparatus. However, these measures inevitably lead to a large size apparatus and an increase in energy costs.

In the case of the infrared type drying system, the drying temperature can be kept high to increase the drying capacity. On the other hand, there are disadvantages in this system; there is a difference in the residual water between the black portions of the photosensitive material and the white portions; and when the photosensitive material is dried completely in this system, the gelatin layer either of the black portion or of the white portion is hardened earlier than a mediumly exposed portion of the photosensitive material, and glitters to deteriorate image quality.

In order to solve this problem, the inventors made a study of film drying and found that the residual water ratio of the photosensitive materials and the surface temperature vary as the drying time goes by. As a result, the inventors could draw graphs which show the relation between the residual water ratio and the drying time and the relation between the surface temperature of the photosensitive material and the drying time. They are shown in FIG. 1.

The graph shown in FIG. 1 can be explained as follows.

The solid line in FIG. 1 shows the variation of the residual water ratio with the lapse of time. Since the drying time is equal to 0 at the point of intersection of the left longitudinal axis and the solid line, the residual water ratio of the photosensitive material is equal to 100%.

The broken line in FIG. 1 shows the variation of the photosensitive material surface temperature, which varies with the lapse of time. The point of intersection at which the right longitudinal axis and the broken line intersect, shows the temperature of the drying unit.

The following can be known from FIG. 1.

(1) Although the residual water ratio of the photosensitive material decreases with the lapse of time, the surface temperature of the photosensitive material is constant until the residual water ratio of the photosensitive material reaches a predetermined value.

(2) When the drying time exceeds a predetermined value, the residual water ratio of the photosensitive material gently decreases. However, the photosensitive material surface temperature increases to the temperature of the drying unit.

Giving consideration to the facts (1) and (2) described above, it can be understood that there are two drying regions in drying of photosensitive materials. These regions are defined as the drying-rate-constant-region and the drying-rate-decreasing-region in this specification.

In the drying-rate-constant-region, the heat quantity necessary to evaporate the water which is attached to both sides of the photosensitive material, which will be called 'latent heat for evaporation' of water attached to the surface of the photosensitive material hereafter, is larger than the heat quantity necessary to extract the water contained in the photosensitive emulsion to the surface of the photosensitive material, which will be called 'heat for diffusion' of the water contained in the emulsion layer hereafter. Referring to the solid line in FIG. 1, the residual water volume in the photosensitive material decreases with the lapse of time. However, referring to the broken line in FIG. 1, the photosensitive material surface temperature is kept almost at constant temperature tw° C. which is lower than the drying air temperature t° C.

The drying-rate-decreasing-region is defined as the region in which 'heat for diffusion' necessary to extract the water contained in the emulsion layer of the photosensitive material to the surface, is larger than the 'latent heat for evaporation' necessary to evaporate the water attached to both sides of the photosensitive material. Consequently, 'latent heat for evaporation' to evaporate the water removed to the surface of the photosensitive material, becomes smaller and the heat quantity to increase the photosensitive material surface temperature becomes larger. As a result, the photosensitive material surface temperature is increased to the hot air temperature t° C. which is used to dry the photosensitive material. This is shown by a broken line in FIG. 1.

In the drying-rate-decreasing-region, as the water in the emulsion layer is decreased, 'heat for diffusion' is also decreased. Finally, the water contained in the emulsion layer becomes almost 0. It is the end of drying of the photosensitive material.

The photosensitive material residual water containing rate at the boundary between the drying-rate-constant-region and the drying-rate-decreasing-region, is defined as the critical water content and the boundary is defined as the critical water content point.

To explain in more detail, the critical water content point is the limited point at which 'latent heat for evaporation' is constant. To put it concretely, the critical water content point is the point at which the water attached to the photosensitive material surface becomes almost 0 during the drying process.

FIG. 1 shows an example in which the SR film manufactured by Konica was used as the photosensitive material, wherein the drying unit temperature t was kept at 45° C. and the relative humidity was kept at 40%. In this case, the critical water content was 10 to 25% and the photosensitive material surface temperature tw in the drying-rate-constant-region was 32° C.

The critical water content rate differs with various photosensitive materials according to the thickness of the emulsion layer, the composition, and the structure of the layers. The value of tw also differs with various photosensitive materials and the drying conditions.

Giving consideration to the above, the inventors have found the facts relating to drying of the photosensitive materials as follows: in the hot air current type drying system, it takes a long time to dry the photosensitive materials in the drying-rate-constant-region; in the infrared type drying system, it is possible to reduce the drying time in the drying-rate-constant-region; but the uneven drying is caused by that the photosensitive materials are dried to an extreme extent in the drying-rate-decreasing-region.

The object of the present invention is to solve the problems described above and to provide an improved photosensitive material processing apparatus by making use of the characteristics of both the hot air current type drying system and the infrared type drying system, in order to reduce the drying time of the photosensitive materials so as to improve the processing capacity and to improve image quality by drying the photosensitive materials uniformly.

SUMMARY OF THE INVENTION

A photosensitive material processing apparatus which has a drying unit to dry the photosensitive materials processed by photographic processing solutions, comprises; an infrared drying means to dry the photosensitive materials in the drying-rate-constant-region and a hot air current drying means to dry the photosensitive materials in the drying-rate-decreasing-region.

Since infrared drying is conducted in the drying-rate-constant-region by the apparatus of the invention, the heat quantity supplied to the photosensitive materials becomes large. As a result, the temperature of the photosensitive material surface is kept lower than the temperature of the drying hot air current, and the drying time can be reduced. Since hot air current drying is conducted in the drying-rate-decreasing-region, and whereat the amount of water attached to the photosensitive material surface is already small, drying is conducted according to the amount of water diffused from the inside of the photosensitive material to its surface. For that reason, the photosensitive materials can be prevented from being dried to an extreme extent and dried uniformly and gently.

DETAILED DESCRIPTION OF THE INVENTION

Referring now in detail to the drawings, the photosensitive material processing apparatus of the invention will be explained as follows.

Figure 2:
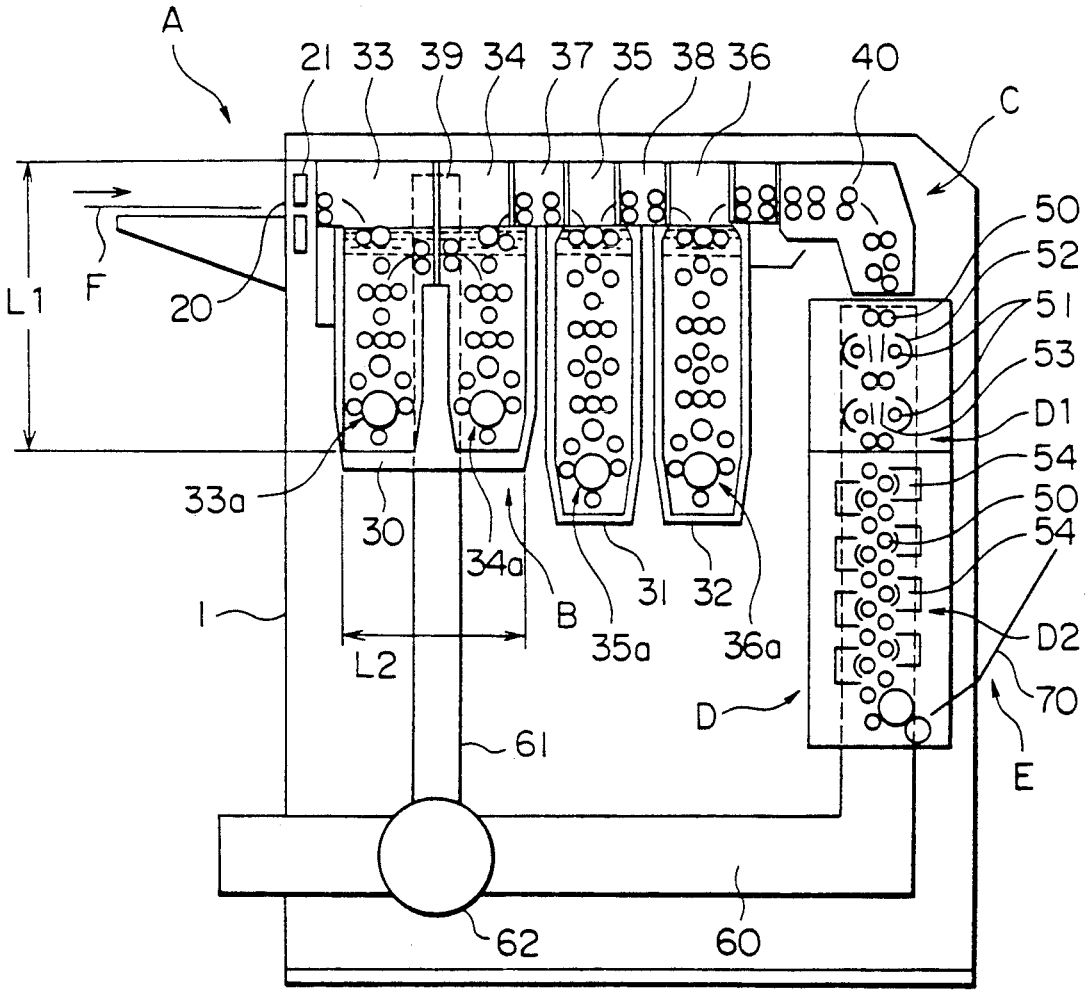
FIG. 2 is a schematic illustration of a photosensitive material processing apparatus of the invention.
Figure 6:
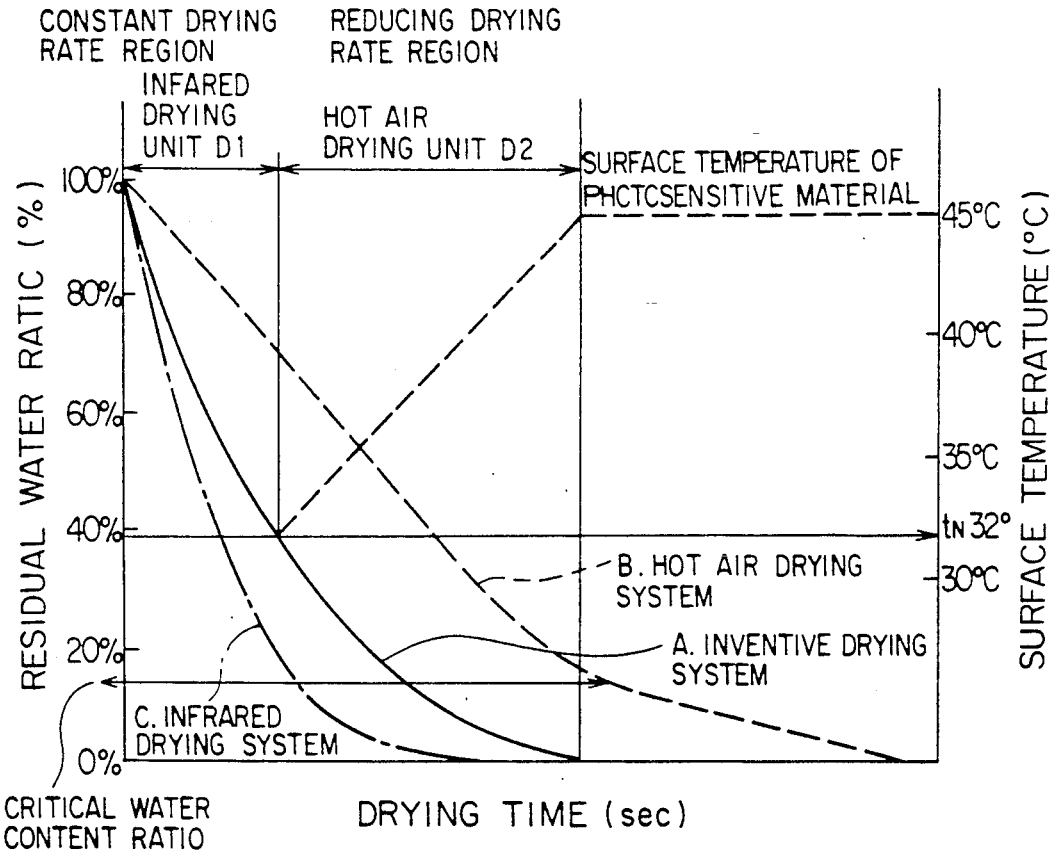
FIG. 6 is a graph in which the drying curves of the photosensitive material at the drying unit are shown.

FIG. 2 is a schematic illustration of the photosensitive material processing apparatus. FIG. 6 is a graph in which the drying curves of the photosensitive material are shown.

In FIG. 2, the letter A is the photosensitive material feeding unit which feeds the exposed photosensitive material. The letter B is the processing unit which processes the fed photosensitive material. The letter C is the squeezing unit which squeezes the processed photosensitive materials. The letter D is the drying unit which dries the processed photosensitive materials. The letter E is the photosensitive material delivery unit which delivers the processed photosensitive material.

The photosensitive material feeding unit A

The exposed photosensitive material sheets F are fed sheet by sheet into the apparatus through the entry opening 20 provided to the upper portion of the apparatus. The detecting sensor 21 is mounted at the entry opening 20 to detect the photosensitive material sheet and to send a signal to the control unit. According to the signal sent to the control unit, the conveying system of the apparatus 1 is driven and at the same time the drying unit D is driven to raise the drying temperature. When the photosensitive material sheet is detected by the sensor 21, the photosensitive material sheet feeding interval is set corresponding to the processing time.

A means to detect the width of the photosensitive material sheet, which is not shown in the drawing, is provided to the photosensitive material sheet feeding unit A to detect the width of the photosensitive material sheet and output the information to the control unit. At the control unit, the area of the photosensitive material sheet is computed according to the information, to determine when the processing solutions are replenished.

The processing unit B

The developing tank 30, the fixing tank 31, the washing tank 32, and another tank are provided to the processing unit B. The conveying racks 33, 34, 35, 36 with feeding rollers are provided to each of the developing tank, the fixing tank, the washing tank, and another tank. The conveying racks can be mounted replaceably on the tanks. When the tanks and the racks are to be cleaned, the conveying roller racks can be easily removed from the tanks. The conveying roller racks 33, 34, 35, 36 have the turning units 33*a*, 34*a*, 35*a*, 36*a* which change the direction of the photosensitive material sheet at the bottom of the tank. The direction of the photosensitive material sheet which is being conveyed downward, is changed to be conveyed upward.

The photosensitive material sheet transferring units 37, 38 are provided between the developing tank 30 and the fixing tank 31, and between the fixing tank 31 and the washing tank 32. The photosensitive material sheet which is conveyed by the conveying racks 33, 34 provided to the developing tank 30, is sent from the developing tank 30 to the photosensitive material sheet transfering unit 37 and there the developer attached to the sheet is squeezed by passing the group of rollers. After that, the photosensitive material sheet is conveyed to the fixing tank 31. In the fixing tank 31, the photosensitive material sheet is conveyed by the rack 35. After fixing, the sheet is conveyed to the transferring unit 38 and the fixing agent attached to the sheet is squeezed at the transferring unit 38. After that, the sheet is conveyed to the washing tank 32. In this way, the processing solution is substantially prevented from bringing the processing solution into the tank for the following process.

Figure 3:
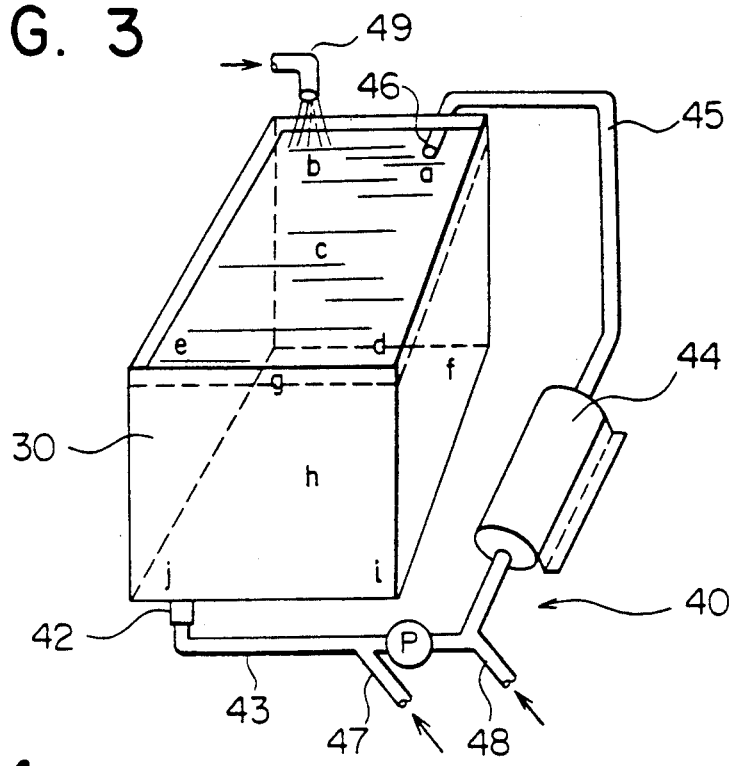
FIG. 3 is a perspective view of a developing tank of the photosensitive material processing apparatus of the invention.

The conveying mechanism provided to the developing tank 30 is composed of the conveying racks 33, 34 equipped with the turning units 33*a*, 34*a*. The conveying racks 33, 34 are arranged along the conveying direction of the photosensitive material sheet. The photosensitive material sheet transferring unit 39 between the conveying racks 33 and 34 is placed in the processing solution so that the photosensitive material sheet is not exposed to the air during conveyance. In this way, the continuous developing process can be conducted in the apparatus. As shown in FIG. 3, the developer circulating system 40 which is for adjusting the developer temperature, is provided to the developing tank 30. The developer is pumped by the circulation pump 41 from the developing tank 30 through the suction port 42 and the pipe 43, and sent to the heater 44. The developer is heated by the heater 44 and discharged through the pipe 45 from the discharge port 46 provided to the upper portion of the developing tank 30 to the developing tank. The developer is circulated in this way so that the developer temperature can be kept constant. The fresh developer can be replenished to the developer circulating system from the supplying pipe 47 provided to the downstream part of the circulating pump or from the supplying pipe 48 provided to the upstream part of the circulating pump, or otherwise the fresh developer may be replenished to the developing tank 30 from the supplying pipe 49 provided to the upper portion of the developing tank 30.

As shown in FIG. 2, the conveying roller racks 33, 34 are provided to the developing tank 30 in parallel with each other. Accordingly, the vertical length $L_1$ is reduced approximately by half compared with the vertical length of a conveying roller rack formed in one block. In this case, the horizontal length $L_2$ of the conveying roller racks 33, 34 becomes longer than that of a conveying roller rack formed in one block. Therefore, the vertical length of the developing tank 30 is reduced by half and the horizontal length of the developing tank 30 becomes longer in accordance with the reduced vertical length of the tank.

Figure 4:
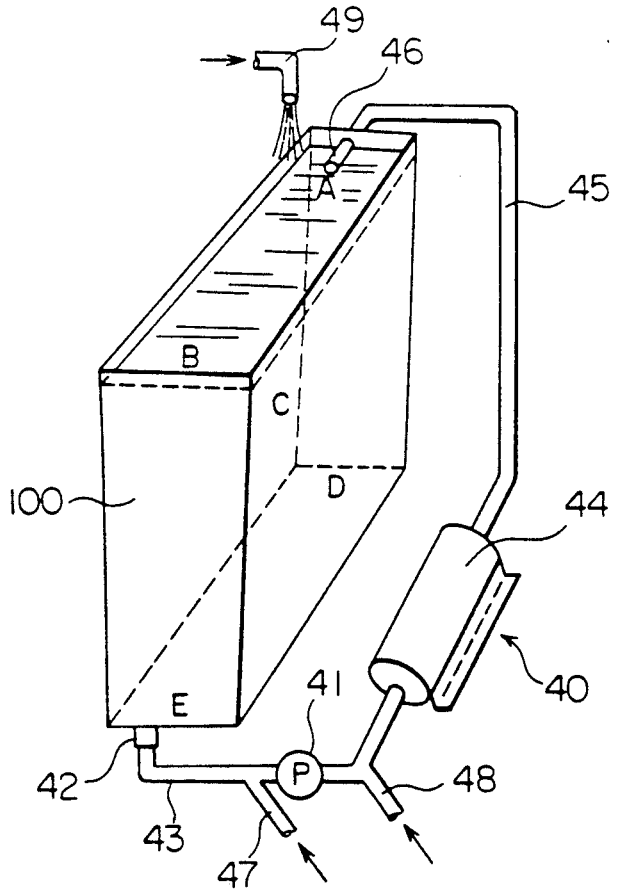
FIG. 4 is a perspective view of a developing tank of a photosensitive material processing apparatus of an example for comparison.
Figure 5:
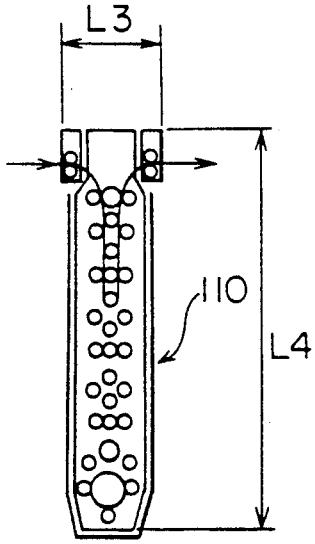
FIG. 5 is a schematic illustration which shows the structure of the conveying roller racks in the developing tank of the example for comparison.

The temperature distribution of the developer in the developing tank 30 in FIG. 2 is shown in Table 1 and Table 2, and also the temperature distribution of the developer in the case that the conveying roller rack illustrated in FIG. 5 is provided to the developing tank illustrated in FIG. 4, is shown in the same tables to make a comparison.

FIG. 4 illustrates the developing tank 100 of the comparative example. FIG. 5 illustrates the conveying roller rack 110 of the comparative example, wherein the long conveying roller rack 110 is placed in the developing tank 100.

The horizontal length $L_3$ of the conveying cack 110 is short and the vertical length $L_4$ is long. The effective length for conveying the photosensitive material sheet in the comparative example is the same as that of the conveying roller racks 33, 34 in the example illustrated in FIG. 2, FIG. 3. Therefore, in the comparative example, the horizontal length of the developing tank 100 is shorter than that of the example illustrated in FIG. 2 and the vertical length of the developing tank is longer than that of the example in FIG. 2. The comparative example has the same developer circulating system 40, including the developer replenishment unit, as the example illustrated in FIG. 2 and FIG. 3. Table 1 shows the developer temperature distribution in the case the developer temperature is set at 35° C. The temperatures were measured at the locations (a) to (j) in FIG. 3 and at the locations (A) to (E) in FIG. 4.

TABLE 1

| Comparative Example | | Example of the invention | |
|---|---|---|---|
| Measuring location | Temperature °C. | Measuring location | Temperature °C. |
| A | 35.0 | a | 35.0 |
| B | 34.9 | b | 35.0 |
| C | 34.7 | c | 35.0 |
| D | 34.6 | d | 34.9 |
| E | 34.5 | e | 34.9 |
| | | f | 34.8 |
| | | g | 34.8 |
| | | h | 34.8 |
| | | i | 34.8 |
| | | j | 34.8 |

Figure 1:
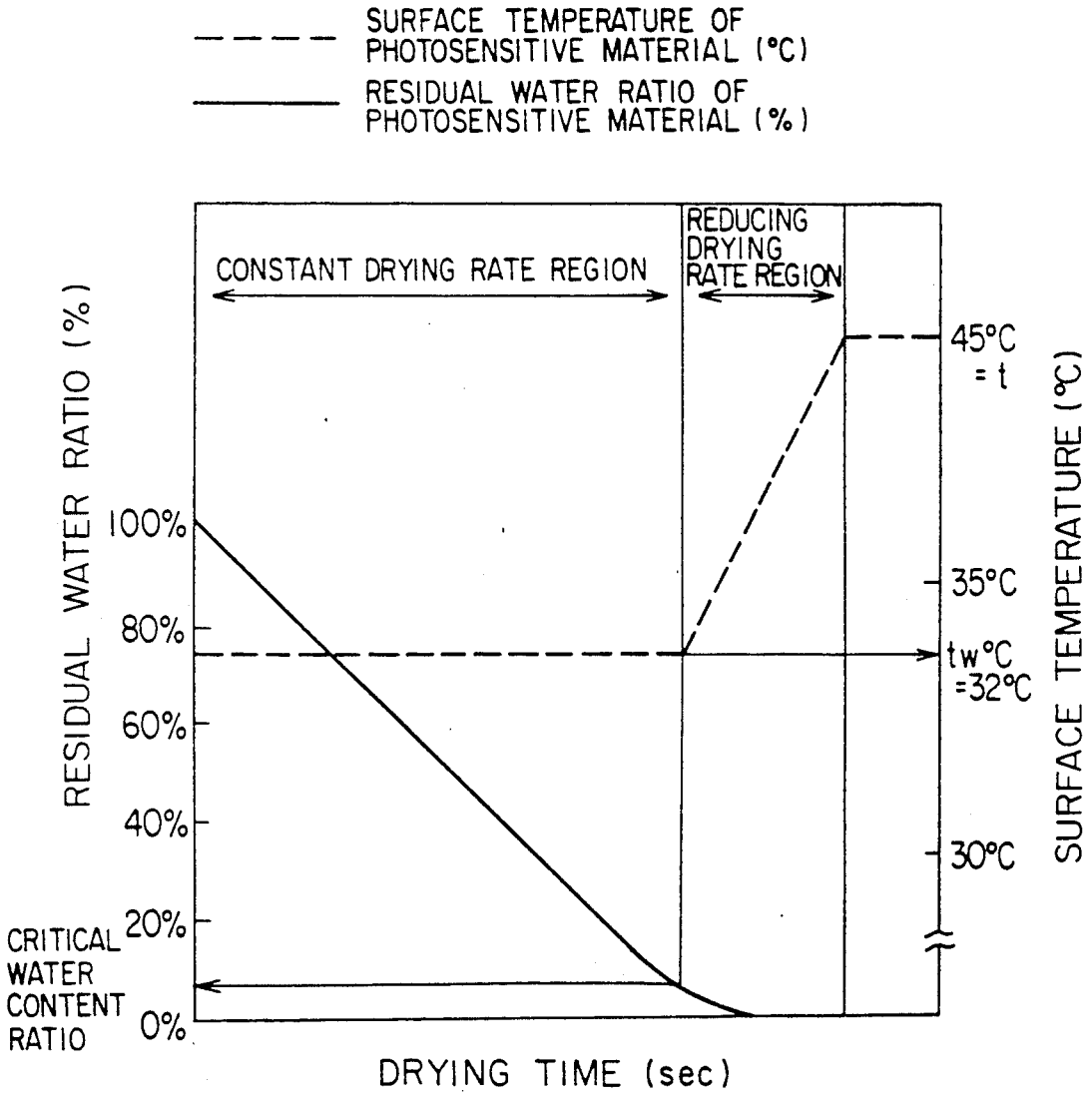
FIG. 1 is a graph which shows the relation between the drying time and the residual water ratio of the photosensitive material, and the relation between the drying time and the surface temperature of the photosensitive material.

The long vertical length of the developing tank 100 of the comparative example in FIG. 4, causes a difference in temperature of not less than 0.5° C. On the other hand, the short vertical length of the developing tank 100 of the example illustrated in FIG. 1 and FIG. 2 causes a difference of temperature of not more than 0.2° C. in spite of the large volume of the developing tank.

Table 2 shows the temperature distribution of the developer when cold developer of 5° C. was supplied to the developing tank 30 of the example illustrated in FIG. 2 and FIG. 3 and to the developing tank 100 of the comparative example illustrated in FIG. 4 and FIG. 5 through the upper replenishing pipe 49 or the developer circulating system 40. The temperature measuring points were the same as those shown in Table 1.

TABLE 2

| Comparative Example | | Example of the Invention | |
|---|---|---|---|
| Measuring location | Temperature °C. | Measuring location | Temperature °C. |
| A | 34.9 | a | 34.9 |
| B | 34.8 | b | 34.9 |
| C | 34.6 | c | 34.9 |
| D | 34.5 | d | 34.8 |
| E | 34.5 | e | 34.8 |
| | | f | 34.8 |
| | | g | 34.8 |
| | | h | 34.8 |
| | | i | 34.8 |
| | | j | 34.8 |

As shown in Table 2, the difference of temperature in the temperature distribution of the developing tank 30 of the example of the invention is smaller than that of the developing tank 100 of the comparative example.

In FIG. 2 and FIG. 3, the photosensitive material sheet F which is conveyed to the apparatus from the photosensitive material sheet feeding unit A, is conveyed downward by the conveying roller rack 33 from the surface of the developer into the developer, turned upward by the turning unit 33*a*, and conveyed to the conveying roller rack 34 through the photosensitive material sheet transferring unit 39 which is placed in the developer. In the same way as the conveying roller rack 33, the photosensitive material sheet is conveyed downward from the surface of the developer into the developer by the conveying roller rack 34, turned upward by the turning unit 34*a*, and conveyed to the fixing tank 31 through the photosensitive material sheet transferring unit 37.

The sending direction of the photosensitive material sheet F is changed at the turning unit 33*a*, the trasfering unit 39, and the turning unit 34*a* in the shallow developing tank 30. Since the sheet F is repeatedly conveyed in the developer in the way described above, a uniform developing effect can be obtained even though the temperature of the developer is not uniform. Furthermore, when the sending direction of the photosensitive material sheet F is changed, the developer in the tank is stirred. As a result, the temperature and density of the developer can be kept uniform without using a particular stirring means. In contrast to that, due to the length of the conveying roller rack 110 of the comparative example illustrated in FIG. 4 and FIG. 5, in which the number of turning units is only one, wherein the turning unit is placed at the bottom of the developing tank, a uniform developing effect and a uniform stirring effect can not be expected.

The comparison between the processing efficiency in the example of the invention and that in the comparative example is shown in Table 3.

As shown in Table 3, the temperature of the developer is kept in the distribution range of 0.5° C. The developer was kept in this range by putting a high temperature developer into a low temperature developer in the processing tank. The range of temperature distribution can be extended by stopping the developer circulation.

TABLE 3

| | Comparative Example Range of temperature distribution °C. | Example of the invention Range of temperature distribution °C. | |
|---|---|---|---|
| | 0.5 | 0.2 | 0.5 |
| Graininess | A | G | G |
| Streamy fog due to the circulation flow | F~G | G | G |
| Streaky marks | A~G | G | G |

Remarks: F→ F stands for Failure. Nonuniformity of the image can be easily distinguished by visual inspection.
A→ A stands for Acceptable. Nonuniformity of the image can be slightly distinguished by visual inspection.
G→ G stands for Good. Nonuniformity of the image can not be distinguished.

As shown in Table 3, in the comparative example illustrated in FIG. 4 and FIG. 5, wherein the temperature of the developer differs from measuring location to measuring location and the sending direction of the photosensitive material sheet is changed only once, accordingly the size of silver particles becomes irregular and nonuniformity of the image is caused. Furthermore, the graininess of the image is deteriorated. Since the developer is hardly stirred, streamy fog due to the irregular circulating flow of the developer and streaky marks by the conveying roller are caused in the image. As a result, image quality is lowered.

On the other hand, in the example of the invention, the apparatus has a plurality of turning units and the developer is stirred sufficiently. Accordingly, even when the developer temperature differs from location to location in the developing tank, processing of the photosensitive material sheet is conducted uniformly. Furthermore, as shown in Table 1 and Table 2, the range of temperature distribution of the developer is small and the developer is stirred by the photosensitive material sheet. Consequently, image quality is improved better in the example.

Furthermore, since the developing tank 30 is shallow, the conveying roller racks 33, 34 are shorter, and therefore lighter, so it is easier to take them out and clean them.

In this example, the developing tank 30 is shallow and two sets of conveying roller racks 33, 34 are used. However, it is to be understood that the invention is not intended to be limited to the specific example. When a plurality of developing tanks and roller racks are used, the effect of the invention can be obtained. Furthermore, a plurality of fixing tanks and conveying racks can be also applied to the apparatus of the invention.

In the example described above, when the photosensitive material sheet transferring unit is provided in the processing solution, the processing becomes stable. When the transferring unit is provided outside of the processing solution, the solution has much chance to be exposed to the air and oxidized or the photosensitive material sheet is squeezed by the rollers outside of the solution and therefore squeeze marks are sometimes caused.

As described above, the invention is characterized in that: a plurality of turning units which change the sending direction of the photosensitive material sheet are provided; when the photosensitive material sheet is turned at the turning unit, the processing solution is stirred; the vertical length of the conveying roller rack can be reduced by providing a plurality of turning units; the depth of the processing tank can be reduced by providing a plurality of turning units and the range of temperature distribution of the processing solution can be made small; even in a processing tank with a wide range of temperature distribution, uniform processing efficiency is obtained since the photosensitive material sheet is conveyed upward and downward a plurality of times in the processing tank; accordingly, nonuniformity of image on the photosensitive material sheet caused during processing can be prevented by a simple structure and image quality can be improved, wherein special means such as a processing solution stirring means and a processing solution temperature control means in the processing solution circulating system are not needed; since the apparatus of the invention has a plurality of conveying roller racks with turning units and the transfering units between the conveying roller racks are placed in the processing solution, the vertical length of the conveying roller racks can be made short and the depth of the processing tank can be made shallow; it is easy to clean the processing tanks and the conveying roller racks, since the length of the conveying racks is short and the weight is light; and the photosensitive material sheet is not exposed to the air while it is processed. As described above, it is possible to stably process the photosensitive material sheet and easily handle the conveying roller racks in the apparatus of the invention.

The squeezing unit C

The water on the photosensitive material sheet F is squeezed by a group of rollers 40 and absorbed in the squeezing rollers. After that, the photosensitive material sheet F is conveyed to the drying unit D to accelerate drying.

The drying unit D

In the drying unit D, the photosensitive material sheet F is conveyed through the conveying passage R which is formed by a group of rollers 50. The first half of the drying unit D is composed of the infrared drying unit $D_1$ to which the infrared heater 51, the reflecting plate 52, and the guide 53 are provided. The latter half of the drying unit is composed of the hot air current drying unit $D_2$ which blows unsaturated hot air against the photosensitive material sheet F through the slit nozzle 54.

As shown by the curve A of the graph in FIG. 6, the photosensitive material sheet F is dried by the infrared drying unit $D_1$ in the drying-rate-constant-region and the sheet F is dried by the hot air current drying unit $D_2$ in the drying-rate-decreasing-region.

Generally speaking, the water content in the black portions of the photosensitive material sheet is larger than that in the white portions. It causes a problem described as follows. When the photosensitive material sheet is continued to dry with the drying capacity which is needed in 'drying-rate-constant-region' beyond the critical water content rate to the 'drying-rate-decreasing-region', drying of the black portions is not finished although drying of the white portions has been finished. In some structure and some composition of the photosensitive material sheet, the surface of the sheet is hardened during the drying process. In this case, the water contained in the photosensitive emulsion of the black portions can not move to the photosensitive material sheet surface. This can be the cause of drying marks. In this example, when the water content is reduced to a value smaller than the critical water content rate, in other words when the photosensitive material sheet is dried in the drying-rate-decreasing-region, the hot air current drying system is adopted so that the black portions and the white portions are dried at almost the same drying speed. As a result, it has become possible to dry the photosensitive material sheet uniformly without causing a change in quality such as hardening of the surface of the photosensitive material sheet.

In this example, the infrared drying system which has a high drying capacity is adopted in the drying-rate-constant-region until the water content rate reaches the critical water content rate. Accordingly, both the black and the white portions can be dried rapidly.

Referring to FIG. 6, the example will be explained. The curve B of the graph in FIG. 6 shows the relation between the residual water content rate of the photosensitive material sheet and the drying time when the photosensitive material sheet is dried only by the hot air current drying system. The curve C shows the relation between the residual water content rate of the photosensitive material sheet and the drying time when the photosensitive material sheet is dried only by the infrared drying system. The curve A shows the relation between the residual water content rate of the photosensitive material sheet and the drying time when the drying system of the example is adopted.

According to FIG. 6, it can be understood that the drying time is shortest when the photosensitive material sheet is dried only by the infrared drying system. However, when the photosensitive material sheet is kept dried by the infrared drying system after the water content has been reduced to a value smaller than the critical water content, in other words in the drying-rate-decreasing-region, drying marks tend to occur on the photosensitive material sheet. Therefore, in the example, the photosensitive material sheet is dried by the infrared drying system until the water content rate reaches a value close to the critical water content rate. After that, the photosensitive material sheet is dried by the hot air current drying system in order to prevent drying marks.

It is possible to distinguish the drying-rate-constant-region from the drying-rate-decreasing-region by; measuring the surface temperature of a photographic film and comparing with the threshold value; measuring the water content of the film and comparing with a set value or distinguishing according to the gradient of the rising temperature in the drying unit.

In the first example, the photographic film is dried by the infrared drying system in the drying-rate-constant-region, wherein the drying capacity of the infrared heater 51 is set to a value so that the water content rate of the photographic film is reduced from 100% to the predetermined critical water content rate while the film passes through the drying unit. In this case, it is necessary to ascertain the critical water content rate of the film by measuring the surface temperature of the film or measuring the volume of water contained in the film. When the critical water content rates of each film are almost equal to each other, the heating capacity of the infrared heater 51 may be kept constant. When the critical water content rate of each film differs from each other, the heating capacity of the infrared heater 51 must be reset according to the film to be processed. In this case, the heater capacity is selected manually or automatically by detecting the kind of a film to be processed.

Figure 7:
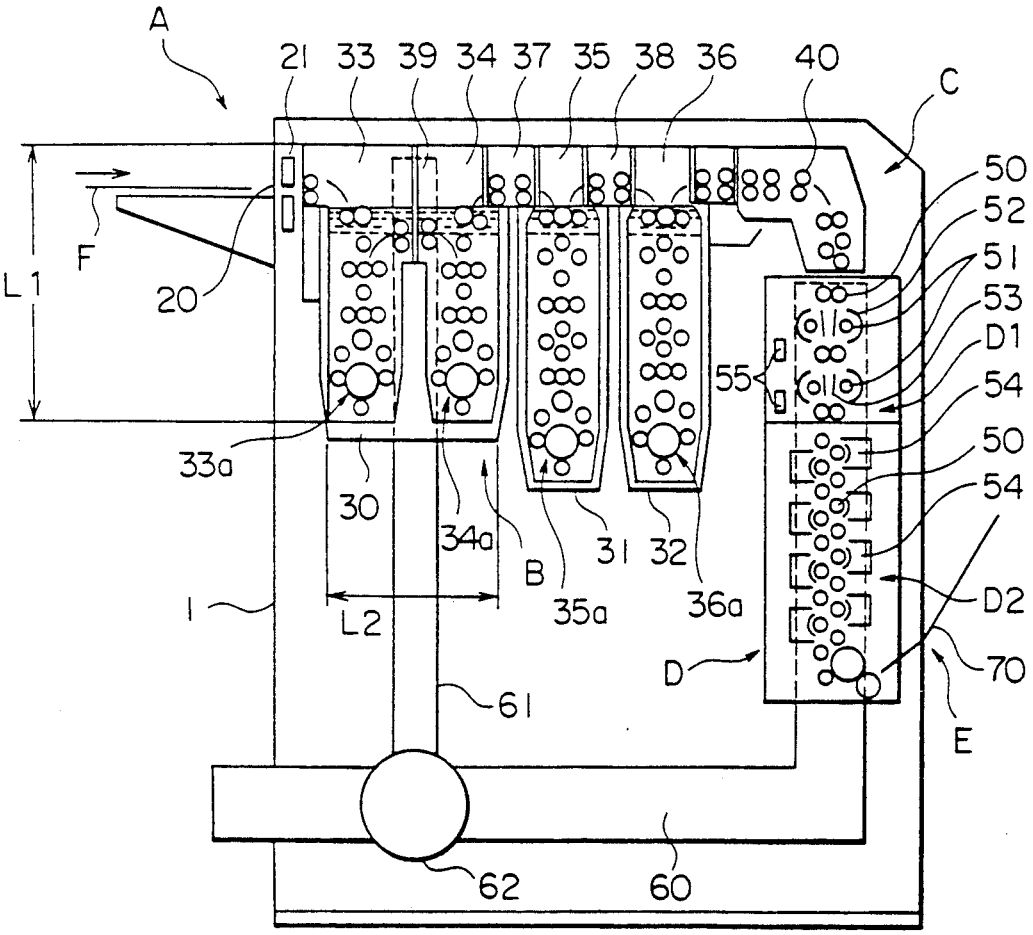
FIG. 7 is a schematic illustration of the photosensitive material processing apparatus of the second example of the invention.

As shown in FIG. 7, the distinguishing means 55 and the infrared heater 51 control means which turns on and off the heater 51, can be provided in the drying unit $D_1$ in order to conduct ON and OFF control of the infrared heater 51, wherein the infrared heater control means is not illustrated in the drawing. In this case, the distinguishing means 55 is the thermal sensor which can measure the gradient of the temperature in the drying unit. The film is dried by the infrared drying system in the drying-rate-constant-region by the method of controlling the drying capacity of the infrared heater 51. The distinguishing means 55 can be replaced by the film surface temperature measuring method and the film water content measuring method. As another example, the distinguishing means 55 may distinguish the drying condition of the film on the basis of the humidity in the drying means. Furthermore, in case that the distinguishing means 55 is provided with a memory storing the physical characteristics of the film, the distinguishing means 55 may distinguish the drying condition of the film on the basis of data stored in the memory.

The evaluation of the dried image quality of this example is shown in Table 4 as compared with the far infrared drying system, the near infrared drying system, and the hot air current drying system.

TABLE 4

| Drying Conditions | | Humidity Variation | | | |
|---|---|---|---|---|---|
| | | High Temperature | | Low Temperature | |
| | | Capacity | Image Quality | Capacity | Image Quality |
| Far infrared ray | 3.6 KW | E | A | E | F |
| | 2.4 KW | G | G | E | A |
| Near infrared ray | 3.6 KW | A | F | G | FF |
| Infrared ray + Hot air current | 3.7 KW | G | E | E | G |
| Hot air current drying | 5.0 KW | A | E | G | G |

Remarks: E stands for Excellent
G stands for Good
A stands for Acceptable
F stands for Failure
FF stands for further worse Failure.

As shown in Table 4, the infrared ray+the hot air current drying system is superior to the far infrared ray drying system and the near infrared drying system in terms of image quality, and superior to the hot air current drying system in terms of drying capacity.

The water evaporated at the drying unit D is discharged outside by the exhaust fan 62 through the exhaust duct 60 together with the exhaust gas sent through the exhaust duct 61 of the processing unit B.

The photosensitive material delivery unit E

The photosensitive material sheet delivery unit E is provided on the opposite side to the photosensitive material sheet feeding unit A of the apparatus 1. The processed photosensitive material sheet F is delivered into the basket 70, wherein the photosensitive material sheet has been developed, fixed, washed, and dried.

Effect of the invention

The photosensitive material sheet processing apparatus of the invention has the drying unit in which the photosensitive material sheet is dried by the infrared drying system in the drying-rate-constant-region and by the hot air current drying system in the drying-rate-decreasing-region. In the drying-rate-constant-region, much heat is supplied to the photosensitive material sheet and the drying time is reduced, because the surface temperature of the photosensitive material sheet is kept at a constant value lower than the hot air current temperature. Since the photosensitive material sheet is dried by the hot air current drying system in the drying-rate-decreasing-region, drying can be conducted controlling the amount of water which is in the emulsion layer of the photosensitive material sheet and diffuses to its surface with the mount of water retained on its surface. As a result, the photosensitive material sheet can be dried uniformly and gently and drying marks can be completely eliminated.

What is claimed is:

1. A photosensitive material processing apparatus, comprising:

processing means for processing a photosensitive material with a solution;

drying means for drying said processed material by at least two sequential drying processes; and conveying means for conveying said processed material from said processing means to said drying means;

said drying means including:

infrared ray drying means for irradiating said processed material with an infrared ray; and hot air drying means located downstream of said infrared ray means in the conveying direction, for generating and applying a hot air current to said processed material;

said conveying means conveying said processed material to said infrared ray means as the first of said two sequential drying processes to dry said processed material to an intermediate dried state and thereafter to said hot air means as the second of said two sequential drying processes to complete drying of said processed material under the influence of only said hot air drying means.

2. The apparatus of claim 1, wherein:

said infrared ray drying means has an adjustable drying capacity; and said apparatus further comprises distinguishing means for distinguishing the state of dryness of said processed material, and means for adjusting the drying capacity of said infrared ray drying means in accordance with the distinguished state of dryness.

3. The apparatus of claim 2, wherein the state of dryness of said processed material changes with a lapse of drying time from a constant drying-rate condition to a decreasing drying-rate condition, wherein in said constant drying-rate condition a water amount evaporated from said processed material per unit of time is substantially constant and in said decreasing drying-rate condition said evaporated water amount per unit of time decreases with the lapse of time, and wherein said distinguishing means distinguishes the state of dryness of said processed material to be in one of said constant drying-rate condition and said decreasing drying-rate condition.

4. The apparatus of claim 3, wherein said adjusting means adjusts said drying capacity of said infrared ray drying means so that said constant drying-rate condition is substantially completed by said infrared ray drying means before said processed material is conveyed to said hot air drying means.

5. The apparatus of claim 2, wherein said distinguishing means includes a sensor to measure the water content of said processed material, and distinguishes the state of dryness of said processed material on the basis of said measured water content.

6. The apparatus of claim 2, wherein said distinguishing means includes a sensor to measure the surface temperature of said processed material, and distinguishes the state of dryness of said processed material on the basis of said measured surface temperature.

7. The apparatus of claim 2, wherein said distinguishing means includes a sensor to measure the humidity near said processed material, and distinguishes the state of dryness of said processed material on the basis of said measured humidity.

8. The apparatus of claim 2, wherein said distinguishing means comprises a memory to store data corresponding to a reference dried state of said processed material, and distinguishes the state of dryness of said processed material on the basis of the stored data.

9. A photosensitive material processing apparatus, comprising:

processing means for processing a photosensitive material with a solution; and drying means for drying said processed material by at least two independently operable drying means, including:

infrared ray drying means as one of said two independently operable drying means, for irradiating said processed material with an infrared ray to at least partially dry said processed material; and hot air drying means as the other of said two independently operable drying means, for generating and applying a hot air current to said processed material; and operating means for independently operating said infrared ray drying means and said hot air drying means in sequence so that said processed material is dried to an intermediate dried state by said infrared ray drying means without use of said hot air drying means and thereafter is further dried to a given dried state by said hot air drying means without use of said infrared ray drying means.

10. The apparatus of claim 9, further comprising distinguishing means for distinguishing the state of dryness of said processed material, and wherein said operating means changes from said infrared ray drying means to said hot air drying means in accordance with the distinguished state of dryness.

11. The apparatus of claim 10, wherein the state of dryness of said processed material changes with a lapse of drying time from a constant drying-rate condition to a decreasing drying-rate condition wherein in said constant drying-rate condition a water amount evaporated from said processed material per unit of time is substantially constant and in said decreasing drying-rate condition said evaporated water amount per unit of time decreases with the lapse of time, and wherein said distinguishing means distinguishes the state of dryness of said processed material to be in one of said constant drying-rate condition and said decreasing drying-rate condition.

12. The apparatus of claim 11, wherein said operating means operates only said infrared ray drying means in said constant drying-rate condition, and operates only said hot air drying means in said decreasing drying-rate condition.

13. The apparatus of claim 10, wherein said infrared ray drying means has an adjustable drying capacity, and said operating means adjusts the drying capacity of said infrared ray drying means in accordance with the distinguished state of dryness.

14. A method of processing a photosensitive material, comprising:

processing a photosensitive material with a solution; and drying said processed material by at least two sequential drying processes;

said two sequential drying processes including:

irradiating said processed material with an infrared ray to dry said processed material to an intermediate dried state, and thereafter applying a hot air current to said processed material to complete drying of said processed material without said irradiating of said processed material with an infrared ray.

15. The method of claim 14, further comprising distinguishing the state of dryness of said processed material and changing from said step of irradiating with an infrared ray to said step of applying a hot air current in accordance with the distinguished state of dryness.

16. The method of claim 15, wherein the state of dryness of said processed material changes with a lapse of drying time from a constant drying-rate condition to a decreasing drying-rate condition wherein in said constant drying-rate condition a water amount evaporated from said processed material per unit of time is substantially constant, and in the decreasing drying-rate condition said evaporated water amount per unit of time decreases with the lapse of time, and wherein said distinguishing step comprises distinguishing said processed material as being in one of said constant drying-rate condition and said decreasing drying-rate condition.

17. The method of claim 16, wherein said processed material is irradiated with an infrared ray during said constant drying-rate condition and is applied with only a hot air current during said decreasing drying-rate condition.

18. The method of claim 17, wherein said processed material is irradiated only with an infrared ray during said constant drying-rate condition without said hot air current being applied.

* * * * *